US006125997A

United States Patent [19]

Campbell

[11] Patent Number: 6,125,997

[45] Date of Patent: Oct. 3, 2000

[54] BASEBALL CAP TRAVEL CASE

[76] Inventor: Steven M. Campbell, 8905 S. Haskell Dr., Broken Arrow, Okla. 74014

[21] Appl. No.: 09/170,712

[22] Filed: Oct. 13, 1998

[51] Int. Cl.[7] ..... A45C 11/02

[52] U.S. Cl. ..... 206/8; 206/278; 220/506; 220/835

[58] Field of Search ..... 220/505, 506, 220/523, 254, 259, 835, 844, 4.22, 4.23; 206/8, 278

[56] References Cited

U.S. PATENT DOCUMENTS

| | | | |
|---|---|---|---|
| D. 318,174 | 7/1991 | Hanson | D3/30.1 |
| D. 344,233 | 2/1994 | Peters | D9/415 |
| D. 371,071 | 6/1996 | Ford | D9/415 |
| D. 378,732 | 4/1997 | Lawson | D9/320 |
| 1,577,632 | 3/1926 | Coles | 206/8 |
| 1,606,811 | 11/1926 | Schilke | 206/8 |
| 1,782,414 | 11/1930 | Duer | 206/8 |
| 2,693,275 | 11/1954 | Smith | 206/8 |
| 2,839,217 | 6/1958 | Trudeau | 220/32 |
| 5,012,531 | 5/1991 | Schoonover | 2/185 B |
| 5,022,515 | 6/1991 | AGostine | 206/8 |
| 5,074,410 | 12/1991 | Fries et al. | 206/8 |
| 5,480,023 | 1/1996 | Puller | 206/8 |
| 5,845,778 | 12/1998 | Hickey, Jr. | 206/8 X |
| 5,865,333 | 2/1999 | Wolfe | 206/8 X |

*Primary Examiner*—Stephen P. Garbe
*Assistant Examiner*—Tri M. Mai
*Attorney, Agent, or Firm*—Head, Johnson & Kachigian

[57] ABSTRACT

A hat travel case including an elongated container body defining a main body portion, the back plate portion, the bill portion and a first enclosed space therein. The main body portion has a main body chamber therein and dimensioned to receive a plurality of billed hats arranged in a shingled array. The billed portion having a bill chamber therein and dimensioned to receive the bill portion of a billed hat. The back plate portion is pivotally connected to the main body portion and allows access to the interior of the travel case so that the plurality of billed hats can be inserted therein. The back plate portion further includes a form preserving means such as a reversed dome attached thereto. The form preserving means secures the plurality of the billed hats and ensures that their shape is maintained.

7 Claims, 5 Drawing Sheets

BASEBALL CAP TRAVEL CASE

BACKGROUND OF THE INVENTION

1. Field of the Invention

The present invention relates to a container for storing and transporting hats. More specifically, the present invention relates to a container for storing and transporting baseball style caps.

2. Prior Art

Containers to store and hold hats are common within the prior art. There are many different styles of hats and related containers. For example, U.S. Pat. No. 2,839,217 issued to Trudeau on Jun. 17, 1958 discloses a portable container which has been designed for the storage and transport of military caps. This device allows for the storage and transportation of a single cap per device and is designed for the sole purpose of military style headwear.

With respect to billed or brim style caps, commonly referred to as baseball caps, storage containers are known in the prior art. Typically baseball caps are stored either singlely or in a shingled array. In order to align the baseball caps in a shingled array, the rear half of the crown portion is folded into the forward half of the crown portion and then is stacked upon another similarly folded baseball cap.

Typically the bill portion of a baseball cap is relatively stiff due to it being constructed of material such as cardboard. The crown portion of baseball caps are generally fabricated from cloth and are usually avoid of stiffening or reinforcing material.

Baseball cap storage devices disclosed in the prior art do not demonstrate a manner in which to prevent the crown portion of a baseball cap from being deformed. For example, U.S. Pat. No. 5,480,023 issued to Puller on Jan. 2, 1996 discloses a cap container having an elongated body comprised of material such as cloth. Inside the elongated body baseball style caps can be inserted in a shingled array. Cloth material of the elongated body does not prevent the crown portion of the enclosed baseball caps from becoming deformed.

U.S. Pat. No. 5,022,515 issued to Agostine on Jun. 11, 1991 discloses a hat container for the storage of baseball style caps in a shingled array. This device is made of rigid outer walls defining an interior compartment. Within the interior compartment, baseball caps are loosely restrained. This device, while providing a rigid exterior, does not secure the baseball caps in the interior portion and, thus, does not provide an adequate means to prevent the deformation of the crowned portion of the baseball cap.

None of the above inventions and patents, taken either singlely or in combination, seem to describe the present invention as claimed.

SUMMARY OF THE INVENTION

The hat travel case of the present invention provides a container which conforms to the shape of a baseball-style cap. The container includes an elongated container body having an external configuration generally corresponding to an elongated hat of a traversely crown shape and having a bill on one end thereof. The elongated container body defines a main body portion, a back plate portion and a bill portion as well as a first enclosed space. The main body portion defines a main body chamber being dimensioned to receive a plurality of billed baseball caps arranged in a shingled array. The bill portion defines a bill chamber being dimensioned to receive a plurality of the bill portion of the billed caps arranged in a shingled array.

The back plate portion includes a back plate and is pivotally connected to the main body portion to allow access into the main body chamber in order to insert the plurality of billed hats arranged in a shingled array. This back plate portion can be secured in a closed position by latch means to the main body portion. Further, a form preservation means is attached to the back plate means. The form preservation means is in a domed or curved shape and is used to prevent the crown portion of a baseball cap from becoming crushed or deformed during travel.

As mentioned above, when storing a plurality of baseball-style caps in a shingled array, the back portion of the crown aspect of a baseball cap is folded toward the forward portion of the crown aspect of the baseball cap. This creates a concave surface along the rear portion of a baseball cap. The form preservation means has a reciprocal convex shape and is used to support the folded crown portion. Unlike the prior art, when a plurality of baseball-style caps are stored within the present invention, the form preservation means secures the hat in a medium to tight restriction manner.

The form preservation means can either be solid or include an internal compartment in which items, such as keys, wallets, etc., can be stored.

Accordingly, it is a principal object of the invention to provide a container for compact storage of caps in a shingled array.

It is another object of the invention to provide a container for storage of caps to prevent the deformation of such caps.

It is a further object of the invention to provide a cap container for storage of baseball style caps which prevents the deformation of the crown portion of the baseball cap.

These and other objects of the present invention will become readily apparent upon further review of the following specification and drawings.

DETAILED DESCRIPTION OF THE PREFERRED EMBODIMENTS

Figure 1:
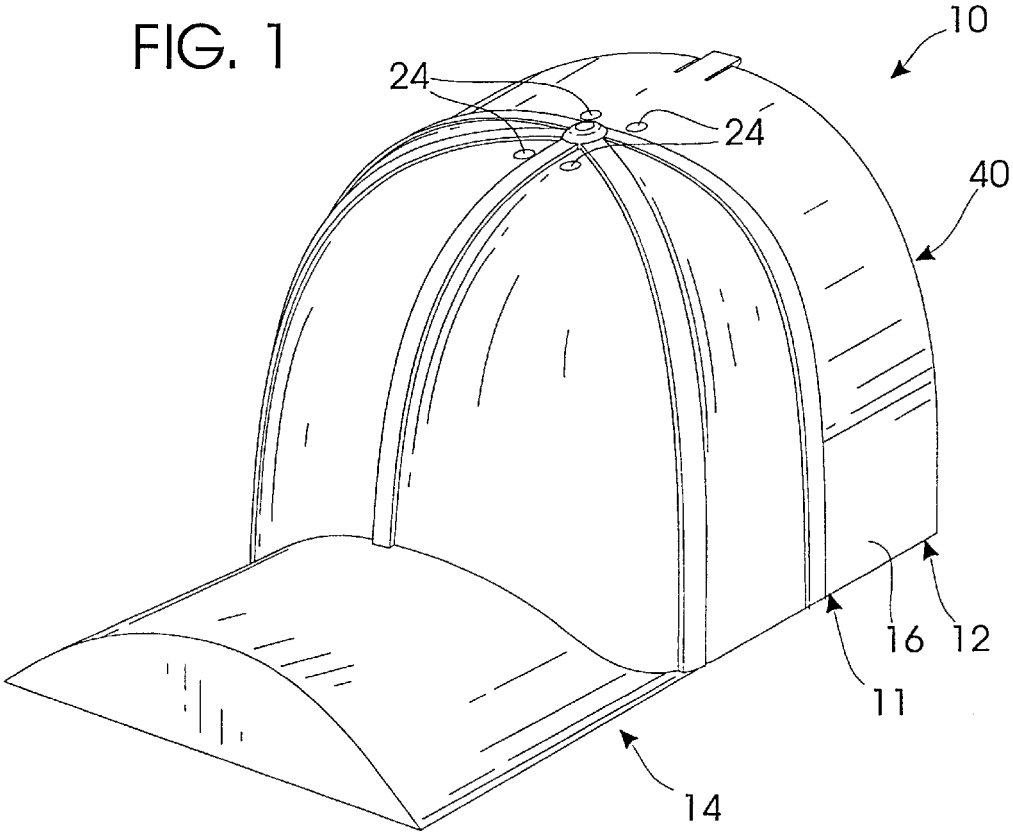
FIG. 1 is a front perspective view of the hat travel case of the present invention.

Referring now to the drawings, the hat travel case 10 of the present invention includes an elongated container body 11 defining a main body portion 12, a back plate portion 40 and a bill portion 14. The elongated container body 11 fully comprises a plurality of walls 16 which enclose a first enclosed space 18. Elongated container body 11 has an external configuration which generally corresponds to an elongated billed hat having a traversely crown shape and having a bill on one end thereof.

Figure 9:
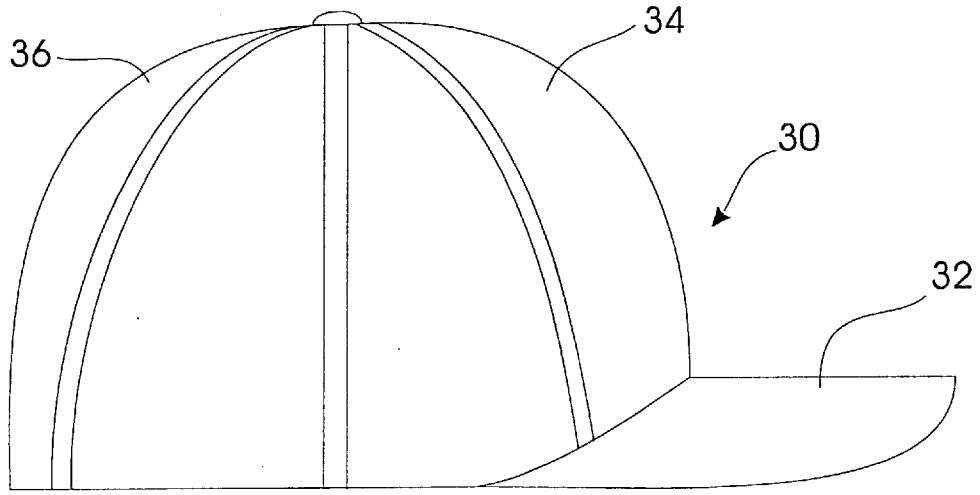
FIG. 9 is a perspective view of a baseball style hat.
Figure 10:
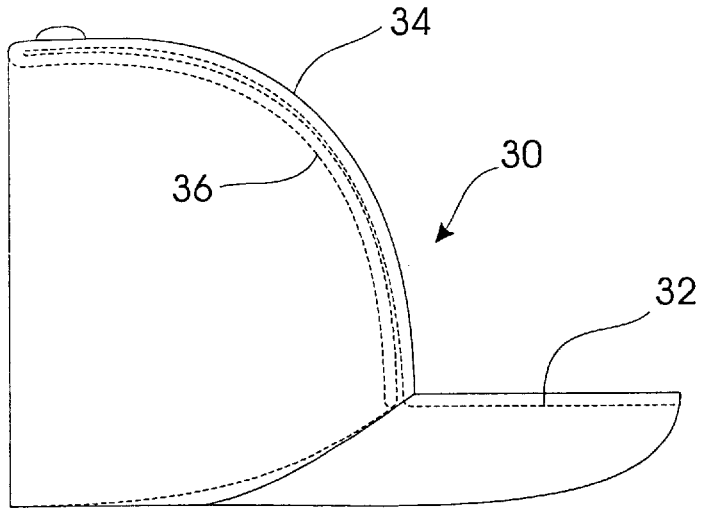
FIG. 10 is a perspective view of a baseball style hat with the back portion thereof folded into the front portion.

Hat travel case 10 is designed to transport and store a plurality of billed hats 30. Billed caps 30 as shown in FIGS. 9 and 10 are generally referred to as baseball caps and include a bill 32, a front portion 34 and a back portion 36. One manner in which to store hats 30 is to fold back portion 36 forward into front portion 34 thereby creating a front portion having a convex shape and a back portion having a concave shape. While in this configuration, multiple hats may be stacked one on top of each other to form a shingled array 38.

Figure 7:
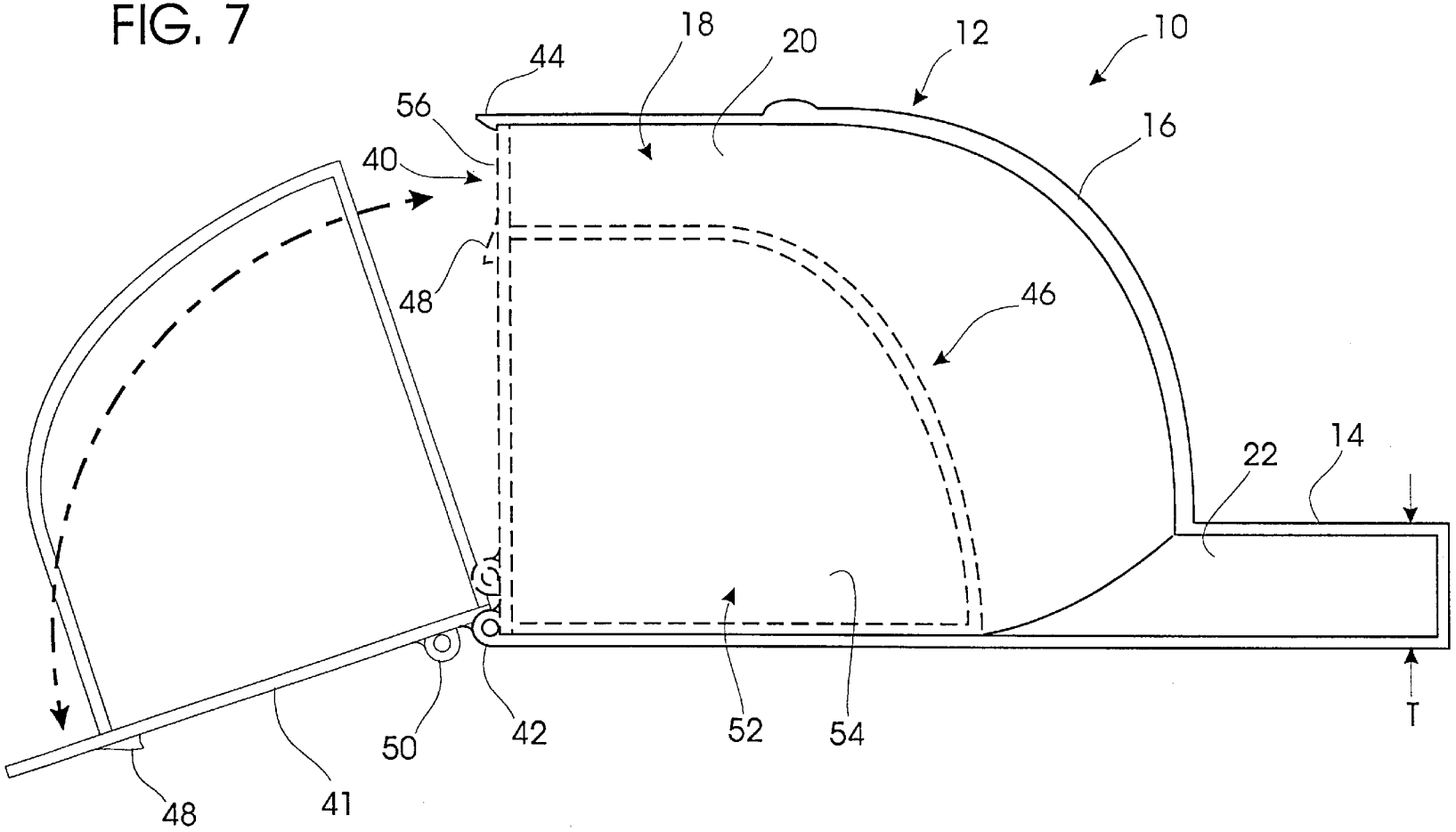
FIG. 7 is a cross-sectional side view of the present invention.

As shown in FIG. 7, first enclosed space 18 has a main body chamber 20 and bill receiving chamber 22. Main body chamber 20 is dimensioned to receive a plurality of hats 30 arranged in a shingle array 38. Bill receiving chamber 22 is dimensioned to receive a plurality of bills 32 arranged in a shingled array 38.

Figure 2:
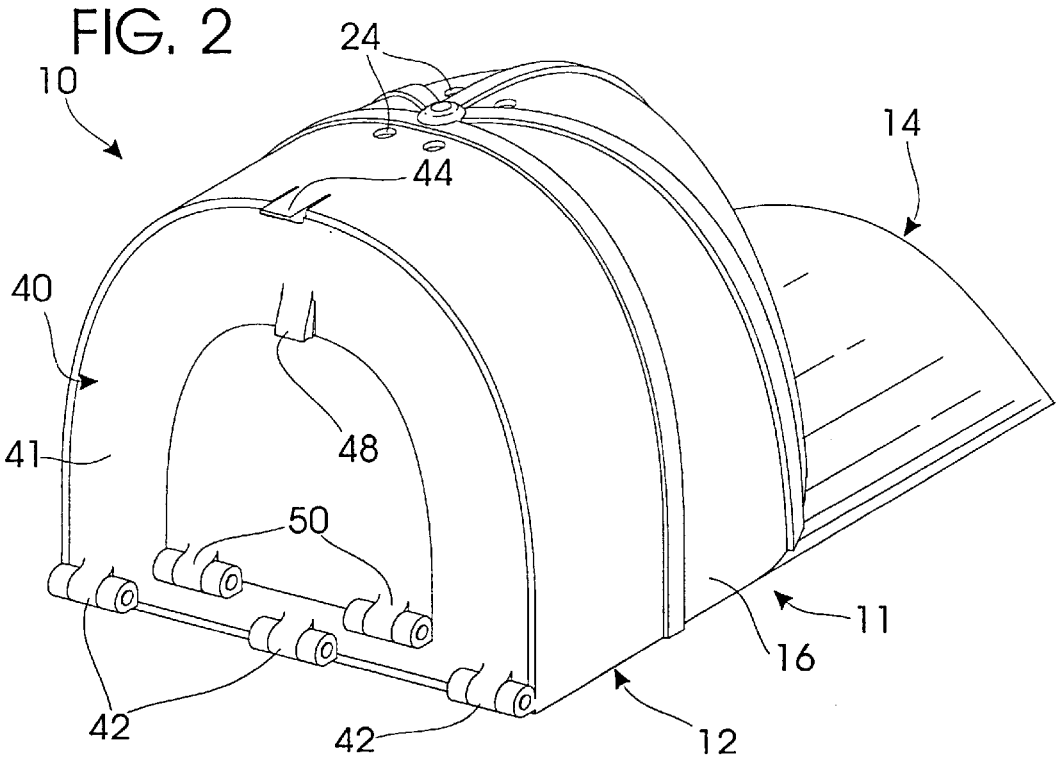
FIG. 2 is a rear perspective view of the hat travel case of the present invention.
Figure 3:
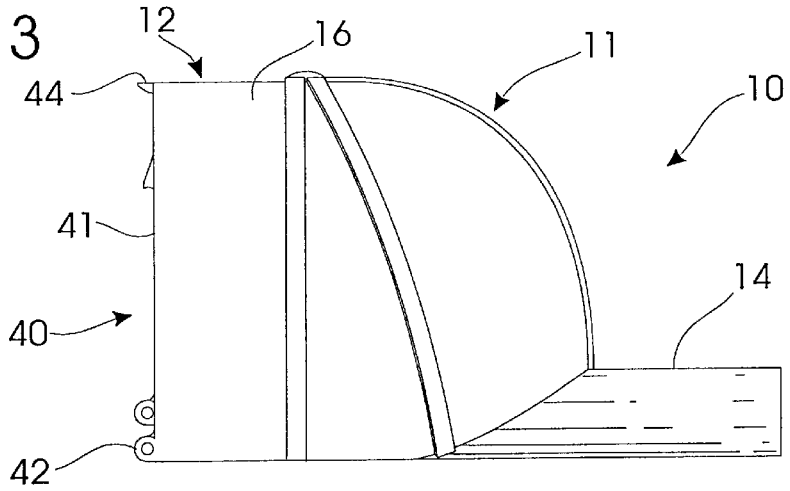
FIG. 3 is a side plane view of the present invention.
Figure 4:
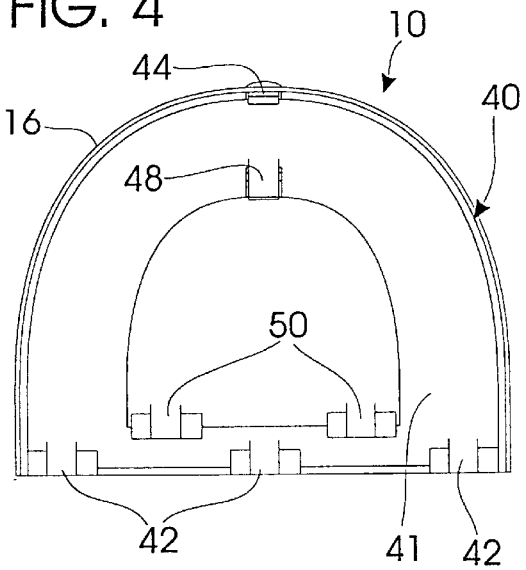
FIG. 4 is a rear plane view of the present invention.

Referring to FIGS. 2 and 7, back plate portion 40 includes back plate 41 which is pivotally connected by pivot means 42 to main body portion 12. Back plate 41 is pivotally moveable from an open position to a closed position. While in the open position, opening 56 is created by which access to first enclosed space 18 is made available. A plurality of hats 30 aligned in a shingled array is able to be placed into the first enclosed space 18 through opening 56. Back plate 41 is able to be pivotally moved into a closed position, thereby, securing hats 30 therein by a first hinge means 42 and can be secured while in a closed position by a first latch means 44.

Figure 8:
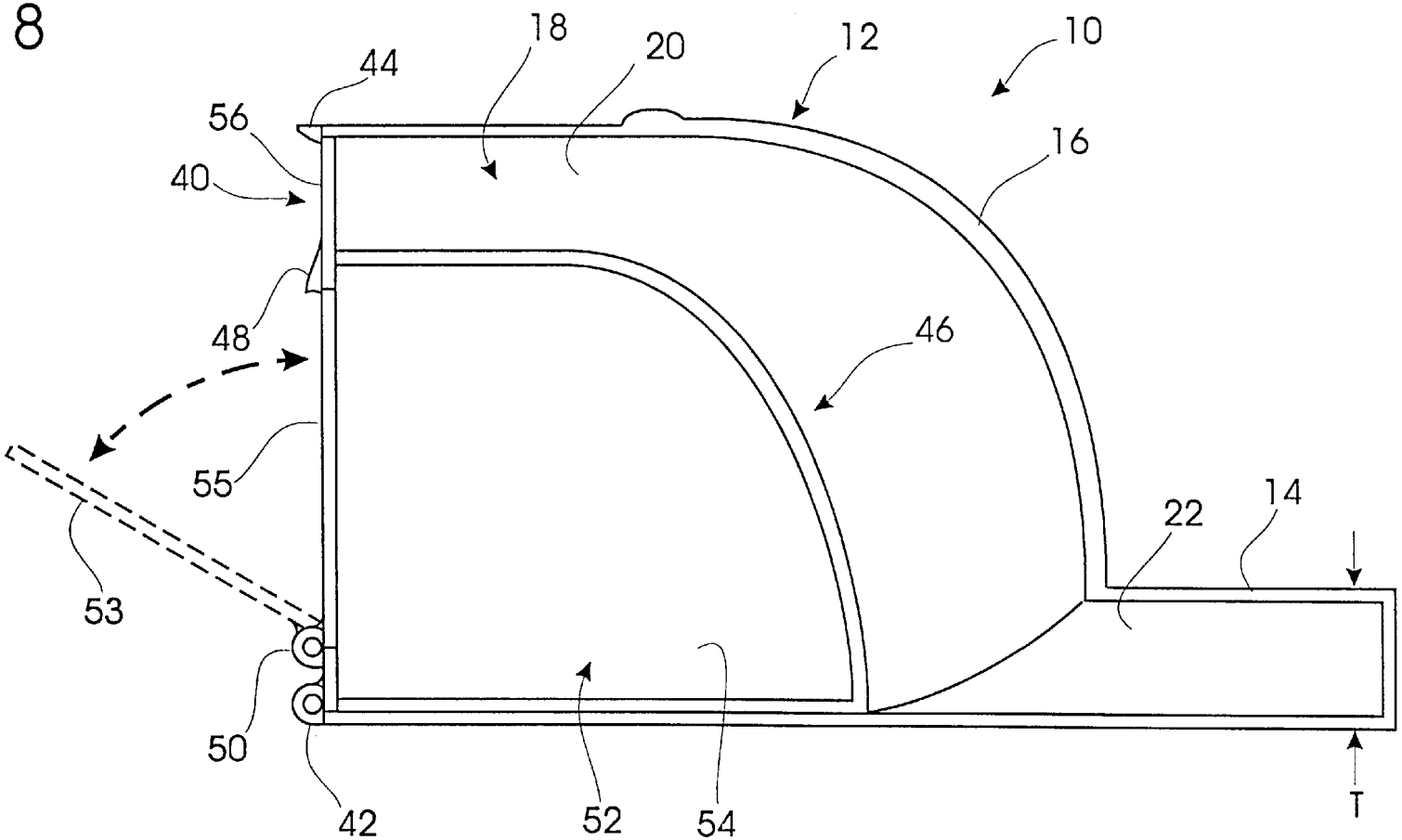
FIG. 8 is a cross-sectional side view of the present invention.

In order to preserve the form of the plurality of hats arranged in a shingled array 38, form preserving means 46 is attached to the interior wall of back plate 41. As shown in FIGS. 7 and 8, one embodiment of form preserving means 46 is shown. Form preserving means 46 may be rigidly fixed to back plate 41 or it may be pivotally connected thereto. When form preserving means 46 is pivotally connected to back plate 41, it defines a second enclosed space 52 having an interior compartment 54 for the storage of personal items, such as keys and money. Within back plate 41 is plate 53. Plate 53 is pivotally connected by hinge 50 and is secured by latch 48. To gain access into space 52, plate 53 is placed in an open position creating opening 55. Items can then be inserted or removed.

Figure 5:
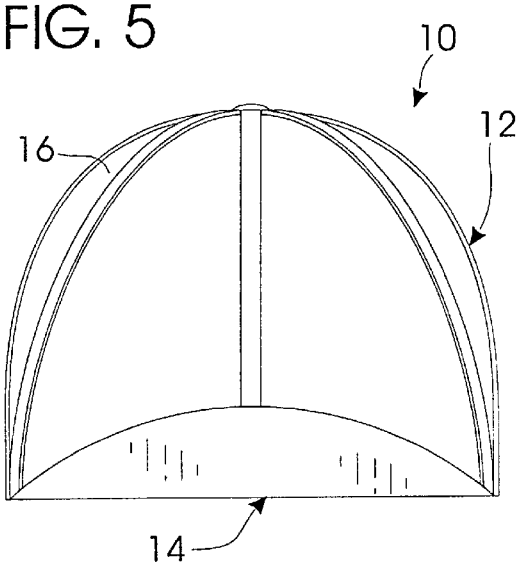
FIG. 5 is a front plane view of the present invention.
Figure 6:
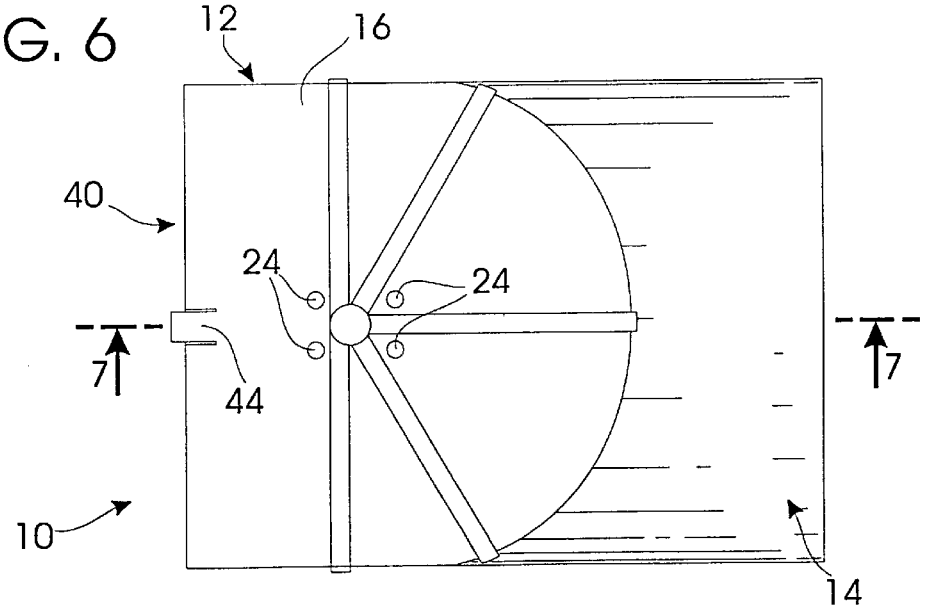
FIG. 6 is a top plane view of the present invention.

Referring now to FIGS. 1 and 5, a front bill portion 14 is shown. Due to use, bill 32 of cap 30 typically obtains a curved shape in order to preserve the curve shape, bill portion 14 can be dimensioned in such a way as to preserve the curvature of bill 32.

Whereas, the present invention has been described in relation to the drawings attached hereto, it should be understood that other and further modifications, apart from those shown or suggested herein, may be made within the spirit and scope of this invention.

What is claimed is:

1. A container for receiving a plurality of billed hats, each hat having a main body portion and a bill portion, each said main body portion having a front portion and a back portion, with each hat being adapted to folding the back portion forwardly into the front portion thereby collapsing the main body portion, the collapsed main body portion having a convex front surface and a corresponding concave back surface, said container comprising:

an elongated container body, having an external configuration generally corresponding to an elongated hat of a transversely domed shape and having a bill on one end thereof, defining a main body portion, a bill portion and a back plate portion, said main body portion defining a main body chamber, said main body chamber being dimensioned to receive a plurality of billed hats arranged in a shingled array;

said bill portion being in communication with said main body portion and defining a bill chamber, said bill chamber being dimensioned to receive a plurality of bills of billed hats arranged in a shingled array, wherein access to said bill chamber is through said main body chamber;

said main body portion having said back plate portion connected thereto, said back plate portion being removable allowing said plurality of billed hats to be able to be inserted or removed from said main body chamber; and said back plate portion, having an external side and an internal side, having a form preserving means attached to said internal side of said back plate portion, and having first opening means, said form preserving means being further defined as having a first enclosed space whereby access to said first enclosed space is through said first opening means, whereby said form preserving means being dimensional to preserve the shape of said main body portion of each said hat.

2. The container of claim 1 wherein said first opening means is a door pivotly connected to said back plate portion.

3. The container of claim 2 wherein said bill portion further being defined as having a front surface having a convex shape, whereby said bill portion front surface resembles a convex front portion of a billed hat.

4. A container for receiving a plurality of billed hats, each hat having a main body portion and a bill portion, each said main body portion having a front portion and a back portion, with each hat being adapted to folding the back portion forwardly into the front portion thereby collapsing the main body portion, the collapsed main body portion having a convex front surface and a corresponding concave back surface, said container comprising:

an elongated container body, having an external configuration generally corresponding to an elongated hat of a transversely domed shape and having a bill on one end thereof, defining a main body portion, a bill portion and a back plate portion, said main body portion defining a main body chamber, said main body chamber being dimensioned to receive a plurality of billed hats arranged in a shingled array;

said bill portion being in communication with said main body portion and defining a bill chamber, said bill portion being defined as having a front surface having a convex shape, whereby said bill portion front surface resembles a convex front portion of a billed hat, said bill chamber being dimensioned to receive a plurality of bills of billed hats arranged in a shingled array, wherein access to said bill chamber is through said main body chamber;

said main body portion having said back plate portion connected thereto, said back plate portion being removable allowing said plurality of billed hats to be able to be inserted or removed from said main body chamber;

said back plate portion, having an external side, an internal side and a door pivotly connected thereto; and a form preserving means attached to said internal side of said back plate portion being defined as having a first enclosed space, whereby access to said first enclosed space is through said door whereby said form preserving means being dimensional to preserve the shape of said main body portion of each said hat.

5. The container of claim 4 wherein said back plate portion is pivotly connected to said main body portion.

6. A container for receiving a plurality of billed hats, each hat having a main body portion and a bill portion, each said main body portion having a front portion and a back portion, with each hat being adapted to folding the back portion forwardly into the front portion thereby collapsing the main body portion, the collapsed main body portion having a convex front surface and a corresponding concave back surface, said container comprising:

an elongated container body, having an external configuration generally corresponding to an elongated hat of a transversely domed shape and having a bill on one end thereof, defining a main body portion, a bill portion and a back plate portion, said main body portion defining a main body chamber, said main body chamber being dimensioned to receive a plurality of billed hats arranged in a shingled array;

said bill portion being in communication with said main body portion and defining a bill chamber, said bill portion being defined as having a front surface having a convex shape, whereby said bill portion front surface resembles a convex front portion of a billed hat, said bill chamber being dimensioned to receive a plurality of bills of billed hats arranged in a shingled array, wherein access to said bill chamber is through said main body chamber;

said main body portion having said back plate portion pivotly connected thereto, said back plate portion being removable allowing said plurality of billed hats to be able to be inserted or removed from said main body chamber;

said back plate portion, having an external side, an internal side and a door pivotly connected thereto; and a form preserving means attached to said internal side of said back plate portion being defined as having a first enclosed space, whereby access to said first enclosed space is through said door, said form preserving means being dimensioned to preserve the shape of a billed hat whereby said form preserving means being dimensional to preserve the shape of said main body portion of each said hat.

7. The container of claim 6 wherein said form preserving means is pivotly connected to said internal side of said back plate portion.

* * * * *